US005787712A

United States Patent [19]

Fukui et al.

[11] Patent Number: 5,787,712

[45] Date of Patent: Aug. 4, 1998

[54] CRYOGENIC REFRIGERATOR

[75] Inventors: Naoki Fukui; Shuji Fujimoto, both of Tsukuba, Japan

[73] Assignee: Daikin Industries, Ltd., Osaka, Japan

[21] Appl. No.: 745,299

[22] Filed: Nov. 8, 1996

[51] Int. Cl.[6] ..... F25B 9/00

[52] U.S. Cl. ..... 62/6; 60/520; 92/192; 277/235 A; 277/236

[58] Field of Search ..... 62/6; 92/192; 277/235 A, 277/236; 60/520

[56] References Cited

U.S. PATENT DOCUMENTS 4,087,988 5/1978 Pallaver et al. ..... 62/6
5,316,321 5/1994 Ishida et al. ..... 277/235 A
5,481,879 1/1996 Asami et al. ..... 62/6
5,551,709 9/1996 Plunkett ..... 277/25 A

*Primary Examiner*—Ronald C. Capossela
*Attorney, Agent, or Firm*—Beveridge, DeGrandi, Weilacher & Young, LLP

[57] ABSTRACT

A cryogenic refrigerator includes a displacer and a cylinder therein for generating a very low temperature. And, a sealing ring is provided in an inserted condition within a ring shaped groove which is formed at an outer peripheral portion of the displacer, the sealing ring having resilience for extending itself outward so that a sealing member on an outer diameter thereof is enlarged and that an outer portion of the sealing ring is slidably contacted to an inner face of the cylinder, and the sealing ring being made of non-magnetic alloy, thereby a magnetic noise and disturbance of an outer magnetic field due to the cryogenic refrigerator are greatly decreased.

13 Claims, 4 Drawing Sheets

CRYOGENIC REFRIGERATOR

BACKGROUND OF THE INVENTION

The present invention relates to a cryogenic refrigerator, and more particularly to a cryogenic refrigerator which includes an improved sealing arrangement of an expander.

A cryogenic refrigerator for obtaining a very low temperature by expanding a refrigerant gas such as a helium gas and the like, is known, as is disclosed in Japanese Patent Laid-Open Gazette Sho 62-228841. The cryogenic refrigerator has a two-stage expanding type arrangement in which a first displacer and a second displacer are provided. And, a sealing ring and a sealing member, cooperatively forming a sealing arrangement is provided in an inserted condition on an outer peripheral portion of each displacer, because each displacer moves reciprocatingly within a cylinder which movement is similar to a piston movement.

It is necessary that a sealing ring maintains resilience even when the sealing ring is under a very low temperature and that a sealing ring has a high sealing characteristic and a high abrasion resistance. Therefore, a sealing ring made or stainless steel (for example, SUS302, SUS304, SUS630 and the like) is employed. Further, a cylinder made of stainless steel is employed. When this arrangement is employed, the sealing member engaged with the sealing ring slidably contacts to an inner face of the cylinder following a movement of a displacer which is similar to a piston movement so that a good sealing characteristic is obtained. Furthermore, a frequency in exchanging the sealing ring or the cylinder is greatly decreased because the sealing ring and cylinder have high abrasion resistance.

But, when a sealing ring made of stainless steel is provided to a displacer in an inserted condition, residual magnetization is highly possibly generated in the sealing ring (for example, magnetization is generated by applying cold working to the sealing ring, exposing the sealing ring to low temperature circumstance and the like, then the magnetization becomes residual magnetization). Though, the displacer moves reciprocatingly within a cylinder which movement is similar to piston movement, a magnetic noise is generated due to the residual magnetization and the movement so that a disadvantage arises in that an outer magnetic field thereof is disturbed.

A cryogenic refrigerator is used to cool a superconducting device such as a Superconducting Quantum Interference Device (hereinafter, referred to as a SQUID) to a very low temperature which enables superconducting operation of the superconducting device. And, a SQUID is a device for detecting an extremely weak magnetic field (biomagnetic field and the like), therefore a sensitivity and accuracy in magnetic field detection of the SQUID are extremely lowered when a cryogenic refrigerator generates a magnetic noise and disturbs an outer magnetic field thereof, as is described above. Especially, when a bio-magnetic field is detected as an extremely weak magnetic field so as to obtain a detection result, diagnosis is made based upon the obtained detection result. Therefore, when a sensitivity and accuracy in magnetic field detection are lowered, an accuracy in diagnosis is greatly lowered and an erroneous diagnosis is made in a worst case.

Further, when residual magnetization in a sealing ring is demagnetized, the above disadvantages do not arise. But, when a heat demagnetization method is employed which method heats a sealing ring over a Curie temperature, the sealing ring loses its spring characteristic after the heat treatment, thereby the sealing ring may not exhibit a predetermined sealing characteristic. Furthermore, when an alternating current demagnetization method is employed which method supplies an alternating magnetic field having a constant strength to a sealing ring, and thereafter the strength of the alternating magnetic field is smoothly decreased to zero strength little by little, they are necessary that the sealing ring is rotated to avoid an influence of the earth magnetization and that the strength of the alternating magnetic field is decreased in an extremely smooth manner. Therefore, disadvantages arise in that operation is extremely complicated and that it is difficult that a decreasing rate of strength of the alternating magnetic field is controlled with high accuracy.

Further, when either of the heat demagnetization method or the alternating current demagnetization method is employed, a new magnetization is possibly generated at a stage in which a sealing ring is actually provided to a displacer in an inserted condition and is applied to an actual use.

Consequently, it is almost impossible that a magnetic noise and disturbance of an outer magnetic field due to resilient magnetization of a sealing ring are eliminated, or that a magnetic noise and disturbance of an outer magnetic field due to resilient magnetization of a sealing ring is suppressed to a strength which does not give bad influence to a detection of an extremely weak magnetic field.

The present invention was made in view of the above problems.

It is an object of the present invention to offer a cryogenic refrigerator which greatly suppresses generation of a magnetic noise and disturbance of an outer magnetic field thereof by extremely decreasing a resilient magnetization of a sealing ring.

SUMMARY OF THE INVENTION

A cryogenic refrigerator according to the present invention comprises, a displacer which is housed within a cylinder in a reciprocatingly movable manner, a ring shaped groove which is formed on an outer peripheral portion of the displacer, and a sealing ring which is provided in an inserted condition within the ring shaped groove, the sealing ring having resilience for extending itself outward so that an outer diameter thereof is enlarged and that a sealing member on an outer portion of the sealing ring slidably contacts an inner face of the cylinder, and wherein the sealing ring is made of non-magnetic alloy. In this specification, "non-magnetic alloy" is used to represent paramagnetic alloy which has extremely small magnetic susceptibility (including zero magnetic susceptibility).

It is preferable that the non-magnetic alloy is selected among copper alloy, aluminum alloy, titanium alloy, and high manganese non-magnetic steel.

It is also preferable that the sealing ring is formed by winding a wire rod into a coil shape which wound wire rod is inclined by a predetermined angle with respect to a pitch direction thereof.

When the cryogenic refrigerator is employed, residual magnetization of the sealing ring due to cold working to the sealing ring, exposing the sealing ring to low temperature circumstance and the like, is greatly decreased so that a magnetic noise and disturbance of an outer magnetic field with respect to the cryogenic refrigerator are greatly decreased, because the cryogenic refrigerator comprises the displacer which is housed within a cylinder in a reciprocatingly movable manner, the ring shaped groove which is formed on an outer peripheral portion of the displacer, and the sealing ring which is provided in an inserted condition within the ring shaped groove, the sealing ring having resilience for extending itself outward so that an outer diameter thereof is enlarged and that a sealing member on an outer portion of the sealing ring slidably contacts an inner face of the cylinder, and wherein the sealing ring is made of non-magnetic alloy.

When the non-magnetic alloy is selected among copper alloy, aluminum alloy, titanium alloy, and high manganese non-magnetic steel, operations which are similar to that of the above are performed.

When the sealing ring is formed by winding a wire rod into a coil shape which wound wire rod is inclined by a predetermined angle with respect to a pitch direction thereof, sufficient sealing characteristic is obtained by increasing resilience of the sealing ring for expanding itself in outward. Also, operations which are similar to that of the above are performed.

DETAILED DESCRIPTION OF THE PREFERRED EMBODIMENTS

Hereinafter, we explain embodiments of the present invention in detail by referring to the attached drawings.

Figure 1:
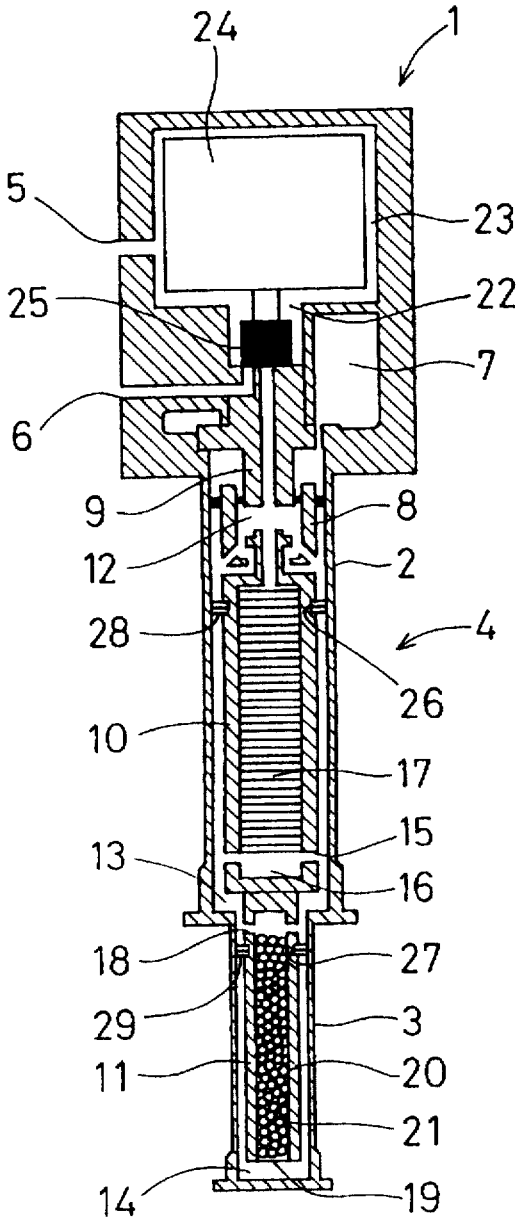
FIG. 1 is a vertical cross sectional view of a main portion of a cryogenic refrigerator according to the present invention.

FIG. 1 is a vertical cross sectional view of a main portion of a cryogenic refrigerator according to the present invention. In FIG. 1, only an expander among components of a cryogenic refrigerator is illustrated.

The expander performs adiabatic free expansion of high-pressure helium gas. The expander comprises a motor housing section 1 which includes a high-pressure gas inlet 5 connected to a high-pressure gas pipe arrangement and a low-pressure gas outlet 6 connected to a low-pressure gas pipe arrangement, and a casing 4 including a cylinder section of two stage arrangement including a first cylinder 2 which has a larger diameter and is located at an upper side, and a second cylinder 3 which has a smaller diameter and is located at a lower side, the first and second cylinders 2 and 3 having central axes which coincide with one another, both cylinders 2 and 3 being provided in one body to one another, and the cylinder section being connected to the motor housing section 1 in one body in a gastight manner. A high-pressure helium gas is supplied to the cylinder section through the high-pressure gas inlet 5.

Further, a serge volume chamber 7 connected to the low-pressure gas outlet 6 is formed within the motor housing section 1.

A slack piston 8 having a cup shape is provided at an upper end section within the first cylinder 2 in an inserted manner. The slack piston 8 being movable reciprocally under a condition that an inner face of the slack piston 8 is slidably guided by a small-diametered trailing section of a valve stem 9. The valve stem 9 includes a capillary and orifice take upon themselves adjustment of flowing quantity to the serge volume chamber 7. The valve stem 9 is provided within the motor housing section 1.

A displacer section is provided within the cylinder section in an inserted manner and in a reciprocally movable manner which displacer section is a sliding body reciprocally moving in an up and down direction within the cylinder section.

The displacer section includes a first displacer 10 and a second displacer 11. The first displacer 10 has a sealed cylinder shape and slides within a lower portion of the first cylinder 2. The second displacer 11 has a sealed cylinder shape and slides within the second cylinder 3. The second displacer 11 is coupled to a lower edge of the first displacer 10 by interposing a coupling (not illustrated), the first and second displacers 10 and 11 being coincident their central axes to one another. An inner space of the cylinder section which space is below the slack piston 8, is separated by the displacer section into a pressure chamber 12, a first expansion chamber 13 and a second expansion chamber 14 in this order from an upper side of the inner space.

A first space 16 continuously connected to the first expansion chamber 13 through a first through-hole 15 is formed within the first displacer 10. And, a first stage cold accumulator 17 consisting of a cold accumulation type heat exchanger is provided within the first space 16 in an inserted manner.

A second space 20 continuously connected to the first expansion chamber 13 through a second through-hole 18 and to the second expansion chamber 14 through a third through-hole 19 is formed within the second displacer 11. And, a second stage cold accumulator 21 consisting of a cold accumulation type heat exchanger is provided within the second space 20 in an inserted manner. Further, the first stage cold accumulator 17 and the second stage cold accumulator 21 may have the same arrangement to one another, or may have different arrangement from one another.

Furthermore, an upper end of the first displacer 10 is engaged to the slack piston 8 and a predetermined clearance is provided therebetween. Therefore, when the slack piston 8 is moved upward, the first displacer 10 begins its upward movement driven by the slack piston 8 through the engagement of the first displacer 10 and the slack piston 8 at a timing when the slack piston 8 has moved upward by a predetermined stroke so as to make the engagement of the first displacer 10 and the slack piston 8. That is, the first displacer 10 moves upward following the slack piston 8 by a delay of the predetermined stroke.

Further, a rotary valve 25 is disposed within a valve chamber 22 of the motor housing section 1. The rotary valve 25 is a changeover valve and is driven its rotation by a valve motor 24 which is disposed within a motor chamber 23. And, the high-pressure gas inlet 5 side and the low pressure gas outlet 6 side are alternatingly connected to the pressure chamber 12, the first stage expansion chamber 13 and the second stage expansion chamber 14 by changeover operation of the rotary valve 25 so that refrigerant flows.

That is, when the rotary valve 25 rotates and operates changeover operation, the rotary valve 25 being driven by the valve motor 24, the displacer section is moved reciprocally within the cylinder section in correspondence to the changeover operation of the rotary valve 25 so that the high pressure gas inlet 5 and the low pressure gas outlet 6 are alternatingly connected to the pressure chamber 12, the first stage expansion chamber 13 and the second stage expansion chamber 14. When the high pressure gas inlet 5 is connected to the pressure chamber 12, the first stage expansion chamber 13 and the second stage expansion chamber 14, high pressure helium gas is introduced and filled within each chamber 12–14 so that the slack piston 8 and the displacer section driven by the slack piston 8 are moved upward. On the other hand, when the low pressure gas outlet 6 is connected to the pressure chamber 12, the first stage expansion chamber 13 and the second stage expansion chamber 14, helium gas Filled within each chamber 12–14 is adiabatically expanded so that cold is generated within the cylinder section.

And, ring shaped grooves 26 and 27 are formed at upper side outer faces of the first displacer 10 and the second displacer 11, respectively. Each ring shaped groove has a rectangular cross sectional shape. Two sealing rings 28, 28 are provided within the ring shaped groove 26, and two scaling rings 29, 29 are provided within the ring shaped groove 27. Two sealing rings and corresponding ring shaped groove constitute a sealing arrangement.

Figure 2:
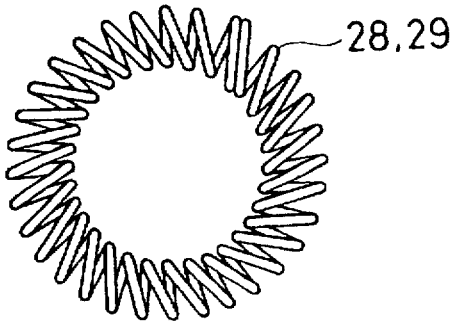
FIG. 2 is a plan view showing a sealing ring of an example.
Figure 3:
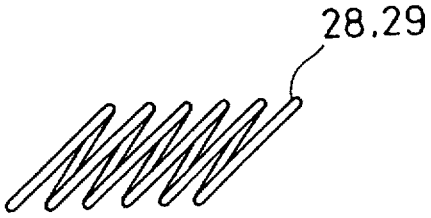
FIG. 3 is a front view showing a main portion of the sealing ring illustrated in FIG. 2.

Each sealing ring provided within one of the ring shaped grooves has a similar arrangement to one another, and is applicable to increase or decrease its diameter within a predetermined extent. Specifically, as are illustrated a plan view in FIG. 2 and a front view of a main portion in FIG. 3, each sealing ring is obtained by the following operations. First, a wire rod made of non-magnetic alloy is wound in a coil shape having a predetermined pitch. Second, the wire rod wound in a coil shape is formed to have a ring shape. Third, the wire rod wound in a coil shape and formed in a ring shape is deformed by applying couple of forces at an upper section and a lower section thereto so that the wire rod is inclined by a predetermined angle with respect to a pitch direction of the wound and formed wire rod. The non-magnetic alloy is exemplified by copper alloy such as beryllium copper, phosphor bronze, and the like, aluminum alloy, titanium alloy, high manganese non-magnetic alloy such as nitrogen reinforced high manganese austenitic steel and the like, Inconel which is high nickelic non-magnetic alloy.

The sealing ring having the above arrangement is a sealing ring which maintains resilience in an expansion direction for increasing its diameter to an original diameter when an outer force for decreasing its diameter is applied to the sealing ring in a free condition. The sealing ring has significant expansion force and superior uniformity in sealing characteristic. A sealing ring in which a wire rod having a larger diameter than that of the above wire rod is formed to have a ring shape and the ring shaped wire rod is made incontinuous condition in its partial portion so as to form a C-ring shape, or a sealing ring in which a wire rod made of non-magnetic alloy is wound to have a ring shape having a predetermined pitch and the ring shaped wire rod is further formed to have a ring shape may be employed instead of the above sealing ring.

Figure 4:
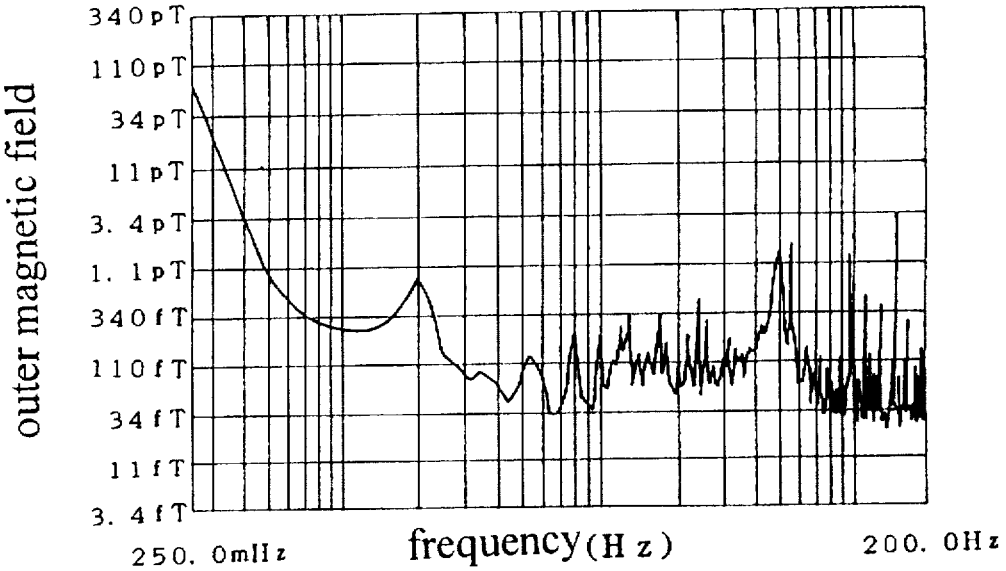
FIG. 4 is a chart illustrating measured frequency characteristic of an outer magnetic field when a sealing ring made of beryllium copper is employed.
Figure 5:
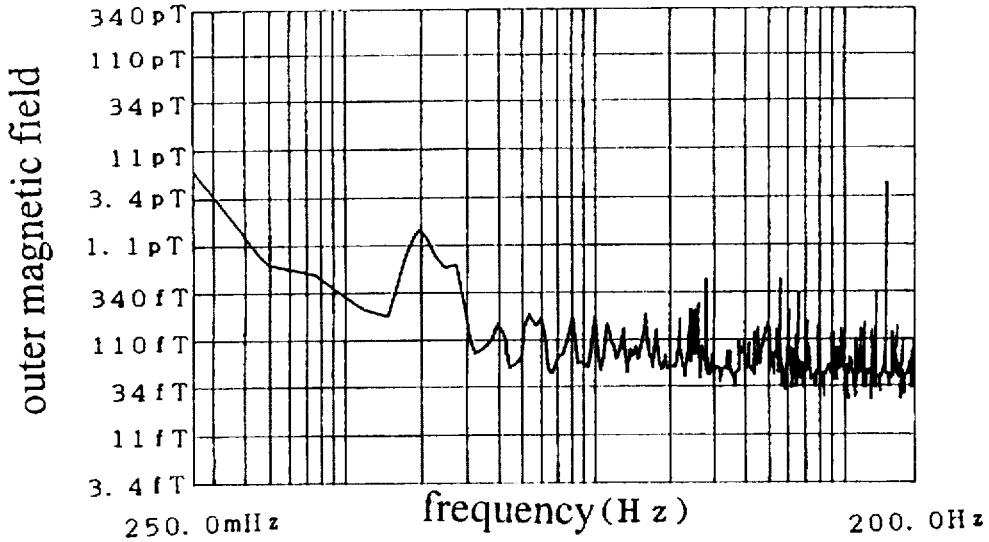
FIG. 5 is a chart illustrating measured frequency characteristic of an outer magnetic field when a sealing ring made of stainless steel is employed.

When a cold corresponding to a very low temperature is generated at a lower end of the second stage expansion chamber 14 using the cryogenic refrigerator (the cryogenic refrigerator employing sealing rings made of beryllium copper) having the above arrangement, and when a SQUID (not illustrated) is in a superconducting condition by the generated cold and is operated, a frequency characteristic of an outer magnetic field was a characteristic illustrated in FIG. 4. On the other hand, when a SQUID is operated using a cryogenic refrigerator which employs sealing rings (having the arrangement illustrated in FIGS. 2 and 3) made of stainless steel instead of sealing rings made of beryllium copper, a frequency characteristic of an outer magnetic field was a characteristic illustrated in FIG. 5. As is apparent from both Figures, a white noise level was 27.5 fT and a peak of 2 Hz-noise was 0.77pT in the case illustrated in FIG. 4, on the contrary, a white noise level was 42fT and a peak of 2 Hz-noise was 1.3pT. Therefore, a peak of 2 Hz-noise which gives great influence to magnetocardiogram measurement and the like is reduced by approximately 40%, and it is understood that a magnetic noise and disturbance of magnetic field are greatly reduced by changing the material of the sealing ring from stainless steel to beryllium copper. Further, when the cryogenic refrigerator employing sealing rings made of beryllium copper is continuously driven for more than 2500 hours, the white noise level and the peak of 2 Hz-noise were scarcely varied and a good stability following passage of time was realized.

Figure 6:
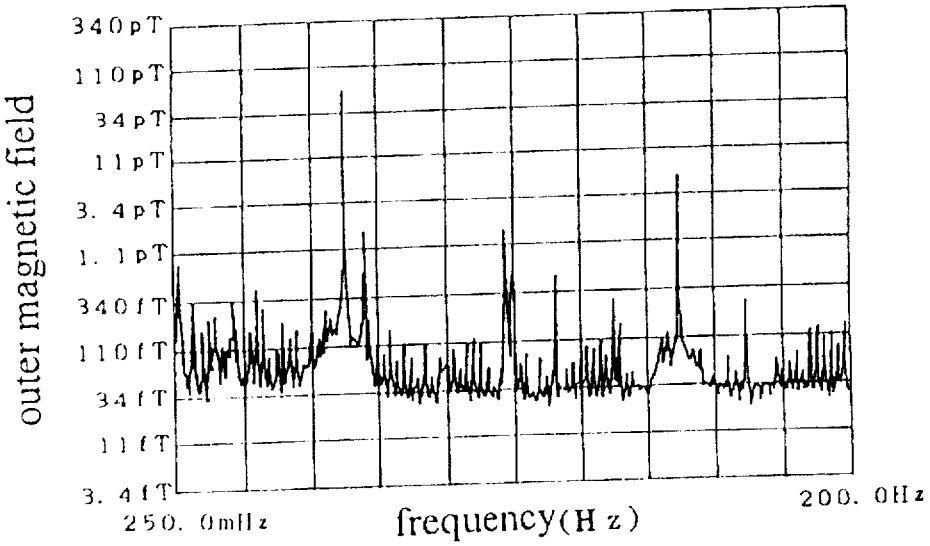
FIG. 6 is a chart illustrating measured frequency characteristic of an outer magnetic field when a sealing ring made of Inconcl is disposed under a room temperature.
Figure 7:
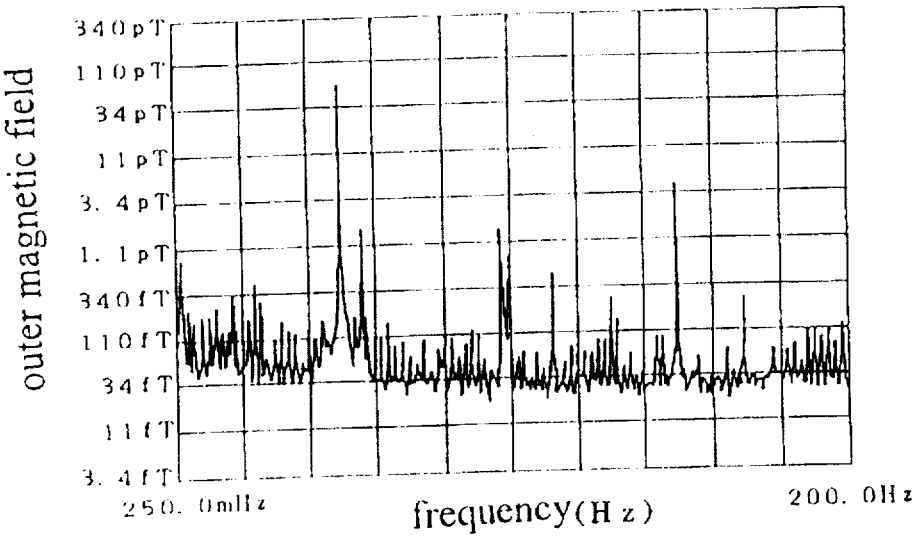
FIG. 7 is a chart illustrating measured frequency characteristic of an outer magnetic field when a sealing ring made of beryllium copper is disposed under a room temperature.

FIG. 6 shows a frequency characteristic of an outer magnetic field when sealing rings made of Inconel are employed and a separately provided SQUID is cooled to a very low temperature and is operated. FIG. 6 represents a frequency characteristic which is similar to that of FIG. 7 which shows a frequency of an outer magnetic field when sealing rings made of beryllium copper are employed. Therefore, it is understood that a magnetic noise and disturbance of magnetic field are greatly reduced.

Further, a frequency characteristic of an outer magnetic field is not actually measured when a SQUID is driven using a cryogenic refrigerator which employs sealing rings made of copper alloy other than beryllium copper, aluminum alloys titanium alloy, or high manganese non-magnetic alloy such as nitrogen reinforced high manganese austenitic steel and the like. But, those materials are non-magnetic material as similar as beryllium copper and Inconel. Therefore, it is expected that residual magnetization of the sealing rings is greatly reduced so that a magnetic noise and disturbance of magnetic field are greatly reduced.

The above description was made for a case in which sealing rings made of non-magnetic material are employed as sealing rings provided to a displacer section in an inserted manner, but, it is of course possible that sealing rings made of non-magnetic material are also employed as sealing rings provided to a slack piston in an inserted manner.

What is claimed is:

1. A cryogenic refrigerator, comprising:

a displacer housed within a cylinder in a reciprocatingly movable manner, the displacer having a ring shaped groove formed on an outer peripheral portion thereof; and a sealing ring received in the ring shaped groove, the sealing ring having resilience for extending itself outward such that an outer diameter thereof is enlarged and such that a sealing member disposed on an outer portion of the sealing ring slidably contacts an inner face of the cylinder, wherein the sealing ring is made of a non-magnetic alloy.

2. A cryogenic refrigerator as set forth in claim 1, wherein the non-magnetic alloy is non-magnetic alloy selected among copper alloy, aluminum alloy, titanium alloy, and high manganese non-magnetic steel.

3. A cryogenic refrigerator as set forth in claim 1, wherein the sealing ring is a wound wire rod disposed in a coil shape, the wound wire rod being inclined by a predetermined angle with respect to a pitch direction thereof.

4. A cryogenic refrigerator, comprising:

a displacer housed within a cylinder in a reciprocatingly movable manner, the displacer having a ring shaped groove formed on an outer peripheral portion thereof; and a sealing ring received in the ring shaped groove, the sealing ring having resilience for extending itself outward such that an outer diameter thereof is enlarged and such that a sealing member disposed on an outer portion of the sealing ring slidably contacts an inner face of the cylinder, wherein the sealing ring is made of a non-magnetic alloy selected among copper alloy, aluminum alloy, titanium alloy, and high manganese non-magnetic steel.

5. A sealing ring for urging a sealing member against a cylinder wall of an expander section of a cryogenic refrigerator, comprising:

a coiled wire member disposed in a ring shape.

6. The sealing ring defined by claim 5, wherein:

said coiled wire member is inclined with respect to a pitch direction thereof.

7. The sealing ring defined by claim 5, wherein :

said coiled wire member comprises a continuous ring.

8. The sealing ring defined by claim 5, wherein:

said coiled wire member is formed of a non-magnetic alloy.

9. The sealing ring defined by claim 8, wherein:

said non-magnetic alloy comprises an alloy selected among the group comprising copper alloy, aluminum alloy, titanium alloy and high manganese non-magnetic steel.

10. The sealing ring defined by claim 9, wherein:

said sealing ring and said sealing member comprise a sealing arrangement.

11. The sealing ring defined by claim 5, wherein:

said coiled wire member comprises a continuous ring, is inclined with respect to a pitch direction thereof and is formed of a non-magnetic alloy.

12. The sealing ring defined by claim 10, wherein:

said non-magnetic alloy comprises an alloy selected among the group comprising copper alloy, aluminum alloy, titanium, alloy and high manganese non-magnetic steel.

13. The sealing ring defined by claim 12, wherein:

said sealing ring and said sealing member comprise a sealing arrangement.

* * * * *